United States Patent [19]

Uang

[11] Patent Number: 4,966,208

[45] Date of Patent: Oct. 30, 1990

[54] PENCIL SHARPENER

[76] Inventor: Chiou-Luh Uang, Long-Jong Street, Yung-Kang Shiang, Tainan Shien, Taiwan

[21] Appl. No.: 470,218

[22] Filed: Jan. 25, 1990

[51] Int. Cl.[5] ..... B43L 23/00

[52] U.S. Cl. ..... 144/28.72; 144/28.7; 144/246 D

[58] Field of Search ..... 144/28.4, 28.5, 28.6, 144/28.7, 28.72, 246 D, 246 F

[56] References Cited

U.S. PATENT DOCUMENTS 3,595,285 7/1971 Rubsen ..... 144/28.72

3,776,286 12/1973 Blanck ..... 144/28.72

4,054,164 10/1977 Kose et al. ..... 144/28.7

*Primary Examiner*—W. Donald Bray

*Attorney, Agent, or Firm*—Bacon & Thomas

[57] ABSTRACT

A pencil sharpener comprises a housing defining a pencil passage, roller means for supporting and conveying a pencil back or forth along the pencil passage, abrasive means driven to rotate around the leading end of the pencil and self-rotate to produce a sharp point on the pencil and a control circuit for automatically performing pencil insertion, pointing treatment to pencil and pencil retraction of this invention.

1 Claim, 4 Drawing Sheets

PENCIL SHARPENER

BACKGROUND OF THE INVENTION

The present invention generally relates to a sharpening device for pencil of the wood encased type, and more particularly to a battery operated pencil sharpener.

Conventionally, manual and electrically operated pencil sharpeners have been made. These pencil sharpeners cut the wood, exposing the lead, and thereby sharpening the lead. For the manual operated pencil sharpeners, the operator had to twist, twirl or rub the lead against the abrasive material. While the prior art discloses electrically operated pencil sharpener utilized with a mechanical holder, the teachings embodied in the constructions have been proven to be less than satisfactory. As the cutter was driven at high speed directly from the motor output shaft. Since commercial grades of writing leads contain a substantial portion of abrasive clay, the cutter soon dulled and the sharpener ceased to function. To this end, the inventor has attempted to make an improved pencil sharpener to overcome the drawbacks of known sharpeners.

SUMMARY OF THE INVENTION

An object of this invention is to provide an improved, pencil sharpener which can diminish the disadvantages of known sharpeners.

It is another object of this invention to provide a pencil sharpener with a construction allowing automatic insertion and retraction of the pencil to be sharpened.

It is a further object of this invention to provide a pencil sharpener having a motor driven pointing device which rotates around the lead.

It is yet another object of this invention to provide a pencil sharpener which points the lead of pencils in a clean and effective manner.

It is yet another object of this invention to provide a pencil sharpener which allows pointing treatments for pencils of various diameters.

With the above object in view, the pencil sharpener of this invention comprises a housing defining a vertical pencil passage, roller means for supporting and conveying a pencil back and forth along the pencil passage and abrasive means driven to rotate around the leading end of the pencil and self-rotate to produce a sharp point on the pencil and a control circuit for automatically performing pencil insertion, pointing treatment to pencil and pencil rotation of this invention.

DETAILED DESCRIPTION OF THE PREFERRED EMBODIMENT

Figure 1:
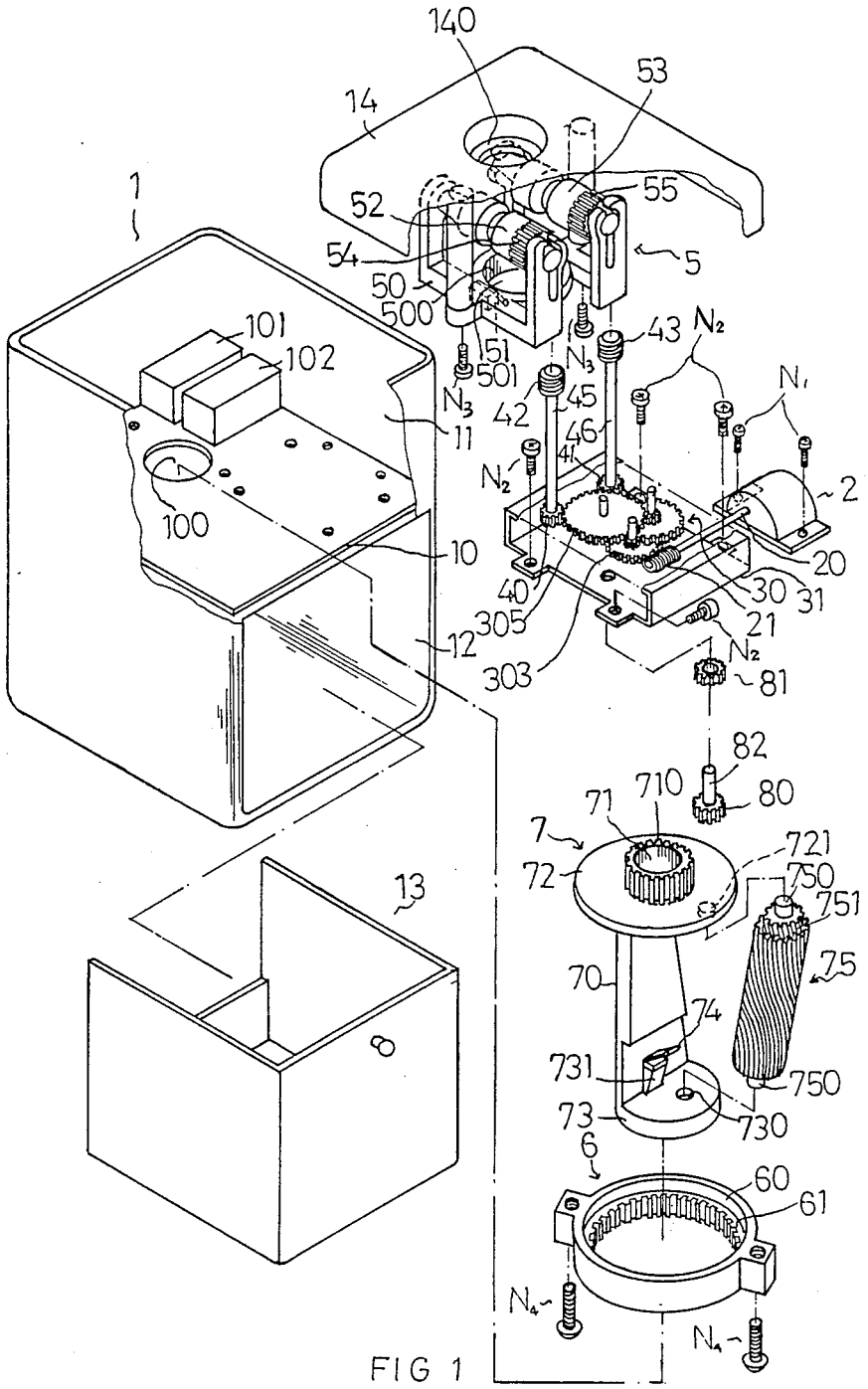
FIG. 1 is an exploded perspective view showing a preferred embodiment of the present invention.
Figure 2:
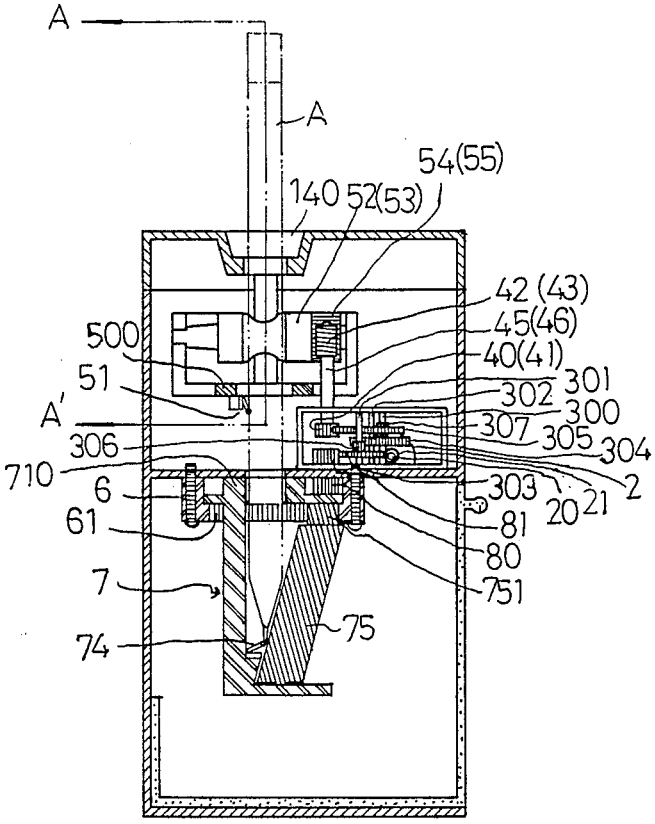
FIG. 2 is a cross-sectional view of the pencil sharpener of the present invention.

Referring now to FIGS. 1 and 2, the pencil sharpener of this invention comprises a housing 1 divided by means of a partition plate 10 into an upper compartment 11 and a lower compartment 12. The housing 1 has an open top removably closed by a cover 14 and a side opening 12 below the partition plate 10 for receiving a drawer-like shavings collector 13. The partition plate 10 is formed with an opening 100 communicating the upper and lower compartments 11, 12. In the upper compartment 11, there is further provided with a battery compartment 101 for fitting a series of dry cells (not shown) in an aiding relationship and a control box 102 for fitting a control circuit means or intergrated circuits having relays a1, a2 (see FIG. 5) on the partition plate 10.

A feeding device 5 is provided under the cover 14 for rolling a pencil downwardly into the lower compartment 12 through the opening 100 of the partition plate 10 to be pointed and further rolling out the pencil after completing pointing treatment. Said feeding device 5 includes a pair of identical rollers 52, 53 rotatably and spacingly mounted on a pair of brackets 50 of which the bottom portions are joined by a ring member 500 defining a circular hole 501. The rollers 52, 53 are circumferentially grooved and provided with gears 54, 55 on one ends thereof. The feeding device 5 is suspended from the cover 14 by a pair of bars extending downwardly from an inner side wall of the cover 14 thus properly spacing the rollers 52, 53 from the cover 14. The brackets 50 have lateral flanges which are secured to lower ends of the bars by means of bolts N3. The ring member 500 is preferably an electrical insulating material such as plastic on which is mounted a pencil switch 51 having a switch pin extending into the circular hole 501. An opening 140 is formed in the cover 14 vertically in alignment with the circular hole 501 of the ring member 500 for inserting therethrough the pencil into the housing 1.

A D.C. motor 2 powered by the dry cells fitted in the battery compartment 101 is mounted on the partition plate 10 and further secured thereto by means of bolts N1. Said motor 2 has an output shaft 20 formed with a worm 21 which meshes an input spur gear 303 of a gear train 30. The gear train 30 includes a plurality of vertical idler stub shafts rotatably mounted in a gear box which is secured on the partition plate 10 by means of bolts N2 and each having a large and a small gear keyed thereto for reducing rotation speed of the motor 2 therethrough.

Two vertical drive shafts 45, 46 have lower ends extending downwardly into the gear box 31 and mounted with gears 40, 41 thereon, which mesh an output spur gear 305 of the gear train 30, and upper ends mounted with worms 42, 43 which are threaded to engage the gears 54, 55 of the rollers 52, 53 in a way that the two rollers 52, 53 are driven to rotate in reverse directions.

A pointing device 7 is disposed in the second compartment 12 and is rotatably supported by a ring-shaped supporter 6 which defines a circular passage 60 and has an internal gear 61 disposed in a lower portion of the circular passage 60 and is secured under the partition plate 10 at a position where the ring supporter 6 surrounds the opening 100 of the partition plate 10. The pointing device 7 includes a disk 72 formed with a central hole (not shown in FIG. 1) and an eccentric recess 721 in a bottom side of the disk 72, a gear 710 rigidly and coaxially mounted on the disk 72 and defining a central hole 71 communicating the central hole of the disk 72, a frame member constituting a substantial vertical portion 70 with its top end attached to an outer portion of the disk 72 and a lug 731 projecting from an inner side wall for mounting a limit switch 74, and a base 73 formed with a recess 730 and an abrasive element 75 having two ends 750 rotatably fitting in the recess 730 of the base 73 and the eccentric recess 721 of the disk 72. The abrasive element 75 has a gear 751 formed on its top portion and adapted to mesh the internal gear 61 of the ring-shaped supporter 6 when the pointing device 7 is rotatably supported by the supporter 6 by resting the disk 72 on the perimeter of the internal gear 61. The periphery of the abrasive element 75 is at an angle with respect to a vertical axis of the inserted pencil A. A stub drive shaft 82 extends upwardly into the gear box 31 through a hole in a bottom plate thereof and rotatably secured thereto with two ends rigidly and respectively mounting with gears 80, 81 thereon of which an upper gear 81 meshes the input spur gear 303 and a lower gear 80 meshes the gear 710 on the disk 72.

Figure 3:
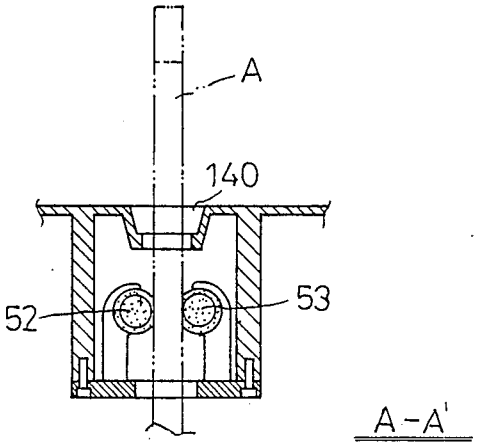
FIG. 3 is an enlarged cross-sectional view taken along line A—A' in FIG. 2.
Figure 4:
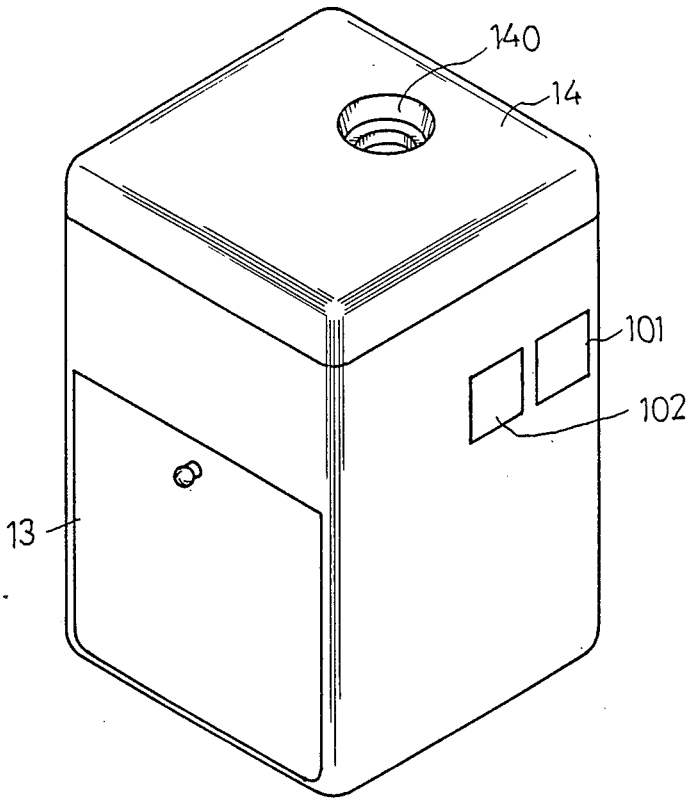
FIG. 4 is a perspective view of this invention in an assembled state.
Figure 5:
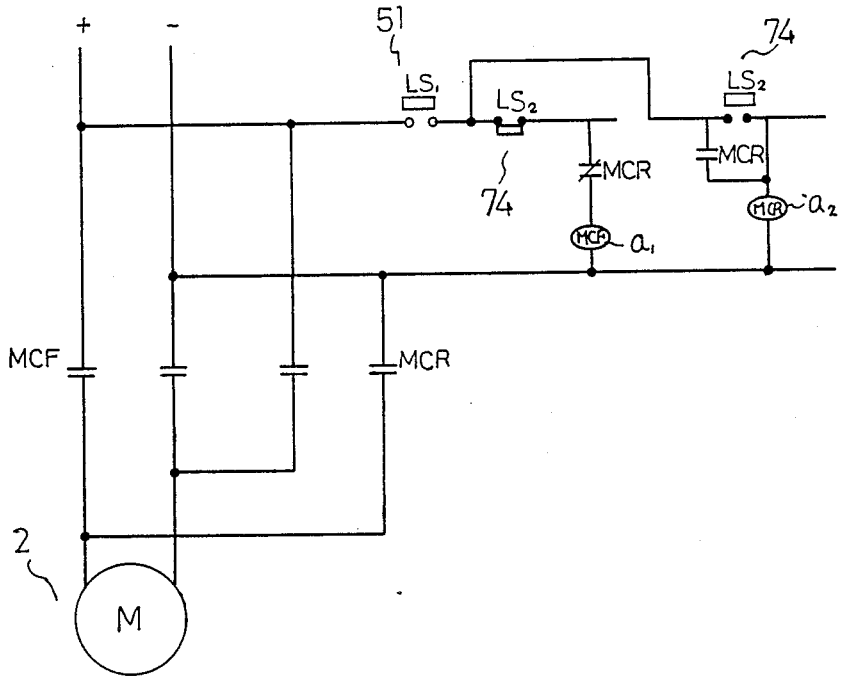
FIG. 5 is a control circuit diagram used in this invention.

Referring to FIGS. 2, 3 and 5, in assembled state the openings 140, 100, 71 of the cover 14, the partition plate 10, the gear 710 and the disk 72 are all in vertical alignment thus defining a vertical pencil passage for intruding the pencil A to be pointed. When inserting the pencil A into the housing 1 through the cover opening 140 along the vertical passage, the leading end of the pencil A will contact the switch 51 thus closing the energizing circuit for motor 2 through the dry cells. Motor 2 drives speed reducing gear train 30 causing rotations of the rollers 52, 53 of the feeding device 5 and the pointing device 7 through the drive shafts 45, 46, 82. The reverse rotations of the rollers 52, 53 drive the pencil A to move downwardly along the pencil passage against the sloping periphery of the abrasive element 75. The disk 72 in association with the frame member thereunder are driven to revolve through the engaged gears 710, 80 relative to the ring-shaped supporter 6 whilst the abrasive element 75 self-rotates through engagement between the gear 751 and the internal gear 61 of the supporter 6. The revolution of the disk 72 in association with the frame causes a conical movement around the leading portion of the pencil A to the abrasive element 75 which, in self-rotation, produces a sharp point on pencil A as the pencil A is maintained against rotation. During the sharpening operation, the shavings are received by the drawer-like collector 13.

The pencil A is kept forcing inwardly by the rollers 52, 53 until the completion of the pointing treatment. Right after that, the pointed end of the pencil A contacts the second switch 74 that closes another energizing circuit of the control circuit, as shown in FIG. 5, to reverse the rotation direction of the motor 2 which drives speed reducing gear train 30 causing reverse rotations of the rollers 52, 53 which coact to retract the pencil A and the pointing device 7 which is in an idle rotation. The retracting pencil A will release the switch 51 and thereby cause to turn off the motor 2. A pointing treatment for a pencil can be easily achieved simply by slightly inserting the pencil into the sharpener until the leading end of the pencil contacts the pencil switch 51. Then the pointing treatment can be automatically accomplished and the pencil can be automatically retracted and the operator does not need to turn off the sharpener as the sharpener will be automatically turned off by a control circuit used herein after the retraction of the pointed pencil. Moreover, different diameters or shapes of pencil or the like can be properly pointed by the sharpener of this invention.

The foregoing detailed description has been given for clearness of understanding only and no unnecessary limitations are to be understood therefrom. Modifications of the present invention may be made by those skilled in the art without departing from the spirit of the invention.

What is claimed is:

1. A pencil sharpener comprising:

a housing having an open top and a side opening in a lower portion of a side wall thereof;

a partition means dividing the housing into a first compartment thereabove and a second compartment having the side opening therebelow;

a shavings collection means adapted to be removably stored in the second compartment and closing the side opening;

a cover means adapted to be removably closing the open top of the housing;

a feeding means having brackets suspended from the cover means and disposed in the first compartment as the cover means closing the open top of the housing, a pair of rollers respectively and rotatably mounted on the brackets and provided with corresponding circumferential grooves and engaging means;

a gear train for reducing rotation speed from an input gear to an output gear thereof, disposed in the first compartment;

a reversible D.C. motor having an output end engaging the input gear of the gear train and powered by dry cells stored in the housing;

means interengaging the output gear of the gear train and the engaging means of the rollers feeding means in a way that driving the rollers to rotate in reverse directions with respect to each other;

a support means attached under the partition means in the second compartment and sequentially defining a cylindrical space and an internal flange provided with teeth in an inner side wall thereof;

a frame means having a circular member having an outer periphery corresponding to an inner side wall of the support means defining the cylindrical space and rotatably resting on the internal flange, an elongation member attached aside to the circular member and extending downwardly through the support means and retaining a base plate spaced from and under the circular member;

a gear member rigidly mounted on the circular member of the frame member within cylindrical space of the secured support means and defining an opening;

a vertical pencil passage defined by an opening in the cover member, a space between grooved portions of the rollers, an opening in the partition means, the opening defined by the gear member mounted on the circular member and an opening in the circular member all in a vertical alignment;

means rotatably secured in the partition means therethrough and interengaging the input gear of the gear train and the gear member mounted on the circular member for rotating the frame member with respect to the support means;

abrasive means rotatably mounted between the circular member and the base plate of the frame member and having a periphery being at an angle with respect to the vertical pencil passage; and a control circuit having a first switch means with a detector extending into the vertical pencil passage in a position close to and below the rollers and adapted to be actuated either to turn on the motor to drive the rollers to rotate so as to drive a pencil retained therebetween for pointing towards the abrasive means along the vertical pencil passage and the frame member and the abrasive means to point a leading end of the pencil inserted thereby, or to turn off the motor, and a second switch means having a detector extending into the vertical pencil passage at its lowermost position and adapted to be actuated to reverse the rotation direction of the motor so as to drive the rollers to move the pencil retained therebetween away from the abrasive means.

* * * * *